US006390891B1

(12) United States Patent
Guha et al.

(10) Patent No.: US 6,390,891 B1
(45) Date of Patent: May 21, 2002

(54) METHOD AND APPARATUS FOR IMPROVED STABILITY CHEMICAL MECHANICAL POLISHING

(75) Inventors: Sumit K. Guha, San Jose, CA (US); Guangying Zhang, Chandler, AZ (US)

(73) Assignee: SpeedFam-IPEC Corporation, Chandler, AZ (US)

( * ) Notice: Subject to any disclaimer, the term of this patent is extended or adjusted under 35 U.S.C. 154(b) by 0 days.

(21) Appl. No.: 09/559,905

(22) Filed: Apr. 26, 2000

(51) Int. Cl.[7] ..... B24B 1/00

(52) U.S. Cl. ..... 451/41; 451/36; 451/56; 451/60; 451/287; 451/548; 451/530; 451/921

(58) Field of Search ..... 451/36, 41, 56, 451/60, 287, 548, 529, 530, 921

(56) References Cited

U.S. PATENT DOCUMENTS

| | | | | |
|---|---|---|---|---|
| 761,597 A | | 5/1904 | Murnane | |
| 2,376,254 A | | 5/1945 | Humphrey et al. | |
| 4,751,797 A | * | 6/1988 | Fujimori | 451/527 |
| 5,212,910 A | * | 5/1993 | Breivogel et al. | 451/530 |
| 5,658,184 A | | 8/1997 | Hoopman et al. | |
| 5,868,806 A | | 2/1999 | Hishio et al. | |
| 6,019,666 A | * | 2/2000 | Roberts et al. | 451/36 |
| 6,022,266 A | * | 2/2000 | Bullard et al. | 451/56 |

* cited by examiner

*Primary Examiner*—Joseph J. Hail, III
*Assistant Examiner*—Shantese McDonald
(74) *Attorney, Agent, or Firm*—Snell & Wilmer, L.L.P.

(57) ABSTRACT

A single-layer polishing pad is grooved in a pattern having relatively large turn radius bends (i.e., greater than the 90° bends of conventional rectangular grid grooving) to improve stability. The large radius bends allow slurry to be more easily and uniformly distributed across the surface of the polishing pad than conventional rectangular grooving. This improvement in slurry distribution tends to improve RR uniformity and WIWNU. In one embodiment, the polishing pad is grooved in a hexagonal pattern, which produces a grooving pattern with 120° bends. The grooves do not penetrate all of the way through the upper layer, thereby maintaining the "stiffness" of the polishing pad, which tends to improve planarization. When used in conjunction with standard pad conditioning techniques, polishing pads with groove patterns having large radius bends has yielded startling and unexpected improvement in stability. The improved fluid distribution provided by the groove pattern is believed to allow the pad conditioning process to clean the polishing pad of residual slurry, polishing debris and polishing by-products more thoroughly than polishing pads with conventional rectangular groove patterns.

20 Claims, 4 Drawing Sheets

METHOD AND APPARATUS FOR IMPROVED STABILITY CHEMICAL MECHANICAL POLISHING

FIELD OF THE INVENTION

The present invention relates to chemical mechanical polishing (CMP) and, more particularly, pad assemblies used by CMP machines.

BACKGROUND INFORMATION

CMP is commonly used in planarizing semiconductor wafers during the fabrication of integrated circuits. A typical CMP system will include an apparatus for holding the wafer, bringing the wafer and a polishing pad into contact, and providing a relative motion between the wafer and polishing pad to polish the wafer surface. In addition, conventional CMP systems provide slurry to aid in the polishing process. In a typical conventional CMP system, the slurry is introduced at the edge of the wafer-polishing pad interface. The slurry typically contains a solution that can react chemically with portions of the wafer surface so that the mechanical action of the polishing pad on the wafer surface can aid the removal of material from the wafer surface.

FIG. 1 shows a top view of conventional polishing pad 10 used in a conventional CMP system. In this system, the slurry is introduced through the pad for better slurry distribution throughout the pad-wafer contact surface. Polishing pad 10 includes a series of grooves 12 arranged to form a rectangular grid. The grooves are typically provided in polishing pad 10 to help channel slurry across the surface of polishing pad 10 during the CMP process. However, the inventors of the present invention have observed that for some applications using polishing pad 10, the removal rate profile can be undesirably non-uniform. As used herein, the removal rate (RR) refers to the rate at which material is removed during the CMP process as a function of the distance along a diameter of the wafer being polished. For example, in a conventional CMP process for polishing a copper layer (i.e., Cu CMP), the inventors of the present invention have observed that the center of the wafer tends to have a lower removal rate. In addition, the inventors of the present invention have observed that conventional Cu CMP processes generally have low stability. That is, the RR performance and the within-wafer non-uniformity (WIWNU) performance degrade as more wafers are polished using a particular polishing pad. As is appreciated by those skilled in the art, CMP process stability is very important in improving yields during the integrated circuit fabrication process. Thus, in a production environment, the polishing pad must be replaced at relatively frequent intervals, thereby undesirably increasing the cost of ownership. Thus, there is a need for a CMP system with improved stability and improved RR and WIWNU performance.

SUMMARY

In accordance with the present invention, a polishing pad that improves CMP RR and WIWNU performance is provided. In one aspect of the present invention, a single-layer polishing pad is grooved in a pattern having relatively large radius bends (i.e., greater than the 90° bends of conventional rectangular grid grooving). In a further aspect, the groove pattern is designed to match the velocity profile on each point of the pad. This type of groove pattern allows slurry to be more uniformly distributed across the surface of the polishing pad compared to polishing pads having conventional rectangular groove patterns. This improvement in slurry distribution tends to improve RR uniformity and WIWNU. For example, in accordance with this aspect of the invention, the polishing pad can be grooved in a hexagonal pattern, which produces a groove pattern with 120° bends. In one embodiment, the grooves do not penetrate all of the way through the polishing pad, thereby maintaining the "stiffness" of the polishing pad, which tends to improve planarization.

Further, the hexagonal grooving pattern, used in conjunction with standard pad conditioning techniques, has yielded startling improvement in stability. The term stability is used in this context to refer to consistent acceptable RR and WIWNU performance over a large number polishing uses. The improved stability reduces cost because significantly fewer polishing pads are needed for polishing a large number workpieces. In addition, the improved stability significantly increases throughput because the polishing pad is not changed as often, thereby decreasing interruptions when polishing a large number of workpieces.

In a further aspect of the present invention, the polishing pad is grooved in a hexagonal pattern by forming a pattern of triangles. For example, six triangles can be arranged to form a hexagon. This aspect of the present invention can be implemented using relatively inexpensive standard polishing pads, which the operator can groove using a standard grooving tool. In particular, the grooving tool is used to form three sets of parallel lines. The second set of parallel lines is formed at an angle of about 60° with the first set, and the third set is formed at an angle of about 60° with the second set. Thus, a hexagonal groove pattern is relatively easily formed in the polishing pad.

DETAILED DESCRIPTION

The present invention is directed toward a polishing pad assembly for use in a chemical mechanical polishing system that improves removal rate and WIWNU performance. The polishing pad is grooved with a large radius turn pattern so that, in combination with the relative motion between the polishing pad and a surface to be polished, the fluid distribution at the polishing pad/surface interface has improved uniformity. The improved fluid distribution improves RR and WIWNU performance and, in conjunction with pad conditioning, dramatically improves stability. Specific embodiments are described below.

Figure 2:
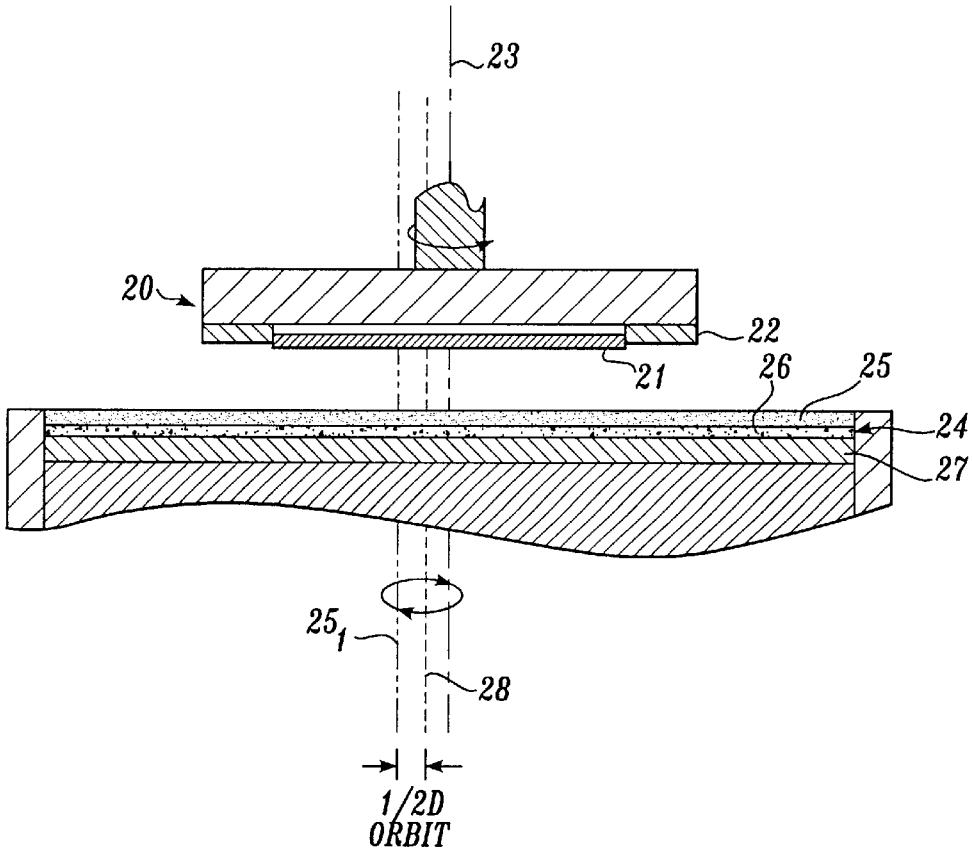
FIG. 2 is a diagram illustrating an orbital CMP machine.

One widely accepted CMP technique is illustrated in FIG. 2; i.e., the orbital CMP polishing technique. For example, an AvantGaard 676 or 776 CMP tool available from SpeedFam-IPEC Corp., Chandler, Ariz. is a suitable example of an orbital CMP tool. In orbital CMP, a carrier 20 is used to hold a wafer 21 using a retaining ring 22. During a polishing operation, carrier 20 rotates about an axis 23 through the center of wafer 21. In addition, wafer 21 is brought into contact with a pad assembly 24. Pad assembly 24 includes a polishing pad 25 and a subpad 26, which form a stacked or layered structure with one surface of polishing pad 25 parallel with and contacting a surface of wafer 21 during the polishing operation. Pad assembly 24 is mounted on a table or platen, with a relatively hard urethane pad backer 27. During the polishing operation, pad assembly 24 is moved in an orbital motion about an orbit axis 28 while carrier 20 rotates wafer 21 about axis 23. In a typical orbital CMP process, the center $\mathbf{25}_1$ of polishing pad 25 is offset from orbit axis 28. The motion of a given point on polishing pad 25 is described in conjunction with FIG. 3 below.

In one embodiment of this system, slurry is introduced to the wafer/polishing pad interface through holes (not shown) in polishing pad 25. During a pad conditioning operation, these holes are also used to provide conditioning fluid to the surface of polishing pad 25. The conditioning fluid may be de-ionized water that is pH adjusted for the slurry. The aforementioned AvantGaard CMP tools have pad conditioning units that can provide such pad conditioning operations.

Figure 3:
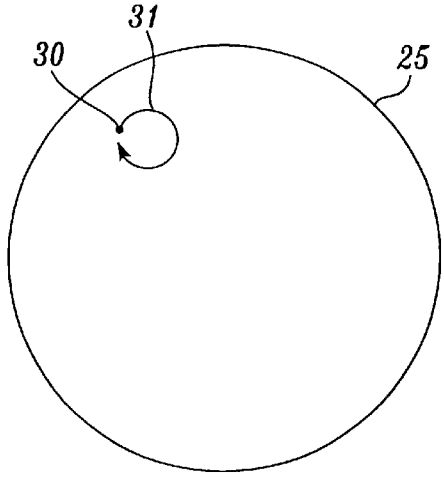
FIG. 3 is a diagram illustrating the motion of a point on a polishing pad during operation of an orbital CMP machine.

FIG. 3 illustrates the motion of a point 30 on polishing pad 25 during an orbital CMP polishing operation. During the polishing operation, point 30 (and every other point) on polishing pad 25 moves in a circular motion, as indicated by an arrow 31 in FIG. 3. The diameter of this circular motion is equal to the orbit diameter. Thus, during the polishing operation, slurry on the surface of polishing pad 25 is urged to move in a circular path. However, the grooving pattern on the polishing pad also influences the distribution of the slurry, as described below.

Figure 1:
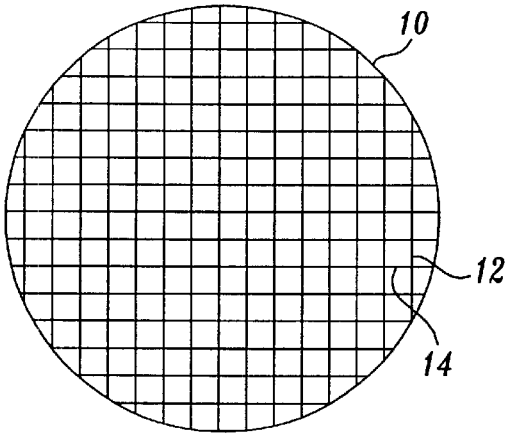
Fig. 1. (PRIOR ART)
FIG. 1 is a plan view of a conventional polishing pad.

The inventors of the present invention have applied fluid mechanics theory to the flow of slurry in the grooves to optimize fluid distribution across the polishing surface. The orbital polishing process urges the slurry to move in a circular path, but as the slurry flows in the grooves, the turns in the grooving pattern can cause the slurry to experience separation from the groove walls. Small turns, such as the 90° turns in the conventional rectangular grooving pattern (FIG. 1), are more susceptible to this problem. The inventors believe that the flow separation leads to the slurry spilling over onto the polishing pad surface near the slurry holes, before the slurry can uniformly disburse across the polishing pad surface. It is believed that this spillover can lead to flooding of the polishing pad surface near the slurry holes. The flooded areas tend to have a lower RR, thereby degrading RR and WIWNU performance.

The inventors also believe another contributing factor is as follows. During the polish process, the movement of the conditioning fluid (residual slurry, polishing debris and polishing by-products) is also influenced by the grooving pattern. Small radius turns inhibit the movement of the by-product fluids, residual slurry, polishing debris and polishing by-products (the inventors have observed polishing by-products in copper polishing applications). Consequently, the ability of the grooves in the pad to remove residual slurry, polishing debris, and polishing by-products from surface of polishing pad 25 is degraded. The inventors believe that accumulation of residual slurry, polishing debris and polishing byproducts negatively impacts the stability of the polishing process using a given polishing pad. The inventors also believe that small turns also negatively impact the pad conditioning process for similar reasons.

Although an orbital system is described above, it is believed that the general principle applies to other types of CMP systems. In particular, it is believed that systems in which the pad is rotated about an axis (e.g., rotational CMP systems) will also tend to urge the slurry to move in a circular path. However, the velocity (and proportionally, the forces acting on an element of fluid) increases linearly from the center to the edge. Consequently, grooving patterns with small turns (e.g., rectangular grooving patterns) will tend to have relatively poor fluid (e.g., slurry, and conditioning fluid) distribution along the surface of the polishing pad or belt.

Figure 4:
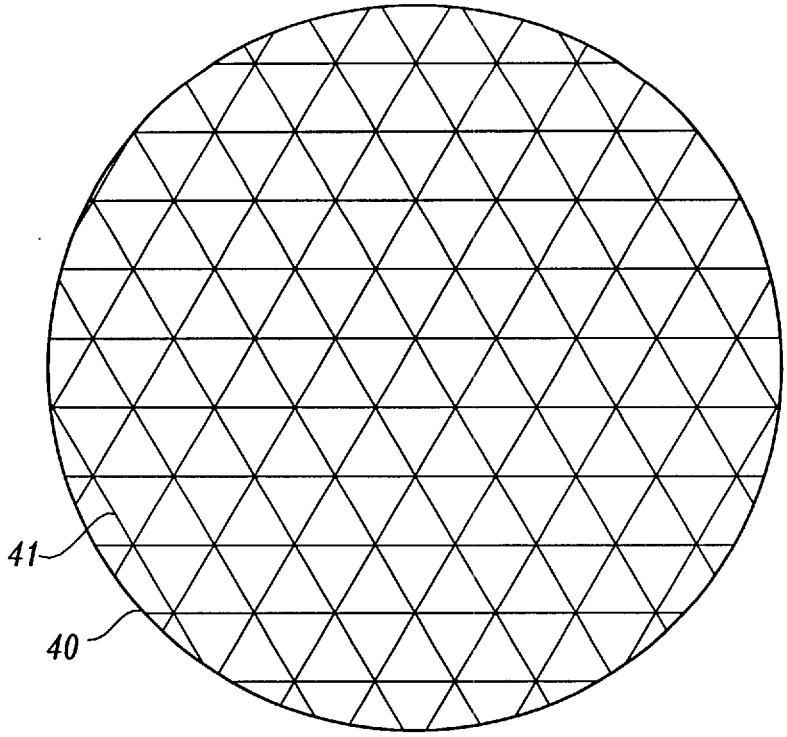
FIG. 4 is a plan view illustrating a patterned polishing pad according to one embodiment of the present invention.

FIG. 4 is a plan view illustrating a polishing pad 40 with grooves 41, according to one embodiment of the present invention. Polishing pad 40 is implemented with standard commercially available polishing pads. The standard polishing pad is pierced with a uniform pattern of relatively small slurry holes (not shown) for through-the-pad distribution of slurry. In addition, grooves 41 are formed in polishing pad 40 in a hexagonal groove pattern. More specifically, grooves 41 form a pattern of triangles on the surface of polishing pad 40, with six triangles forming a hexagon. That is, every intersection of grooves 41 defines the center of a hexagon. In this embodiment, each pair of adjacent sides in a hexagon form a 120° angle. The relatively large angles of the hexagons reduce flow separation during CMP operation as the slurry is urged in a circular path (as described above in conjunction with FIG. 3). This reduction of flow separation leads to improved slurry distribution across the surface of polishing pad 40, which tends to reduce slurry flooding of areas surrounding slurry holes. The reduced slurry flooding in turn tends to improve RR and WIWNU performance.

Figure 5:
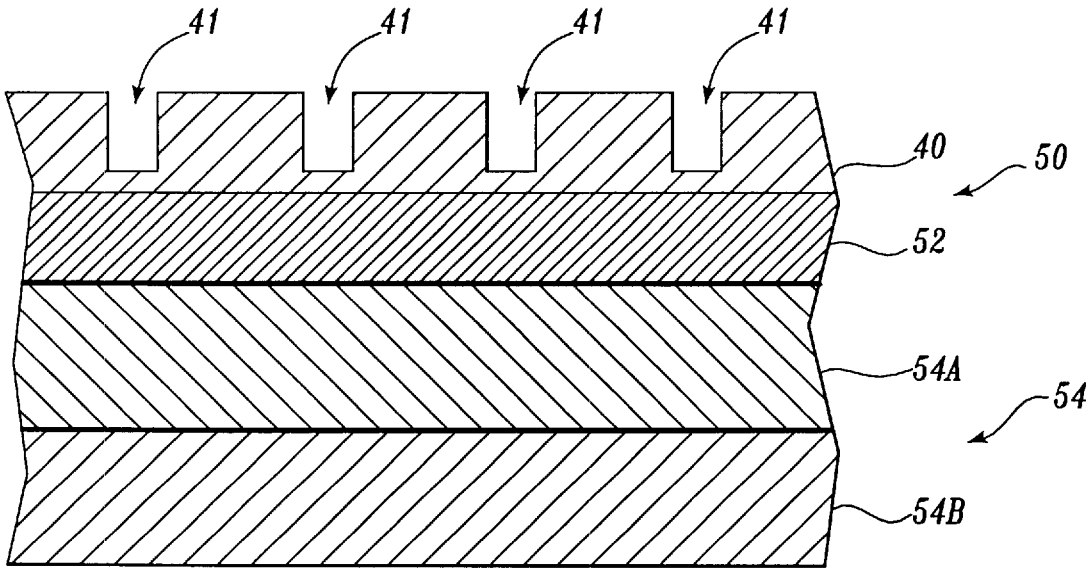
FIG. 5 is a cross-section illustrating part of a polishing pad assembly, according to one embodiment of the present invention.

FIG. 5 illustrates a cross-section of a portion of a pad assembly 50 that includes polishing pad 40 (FIG. 4). In one embodiment, polishing pad 40 is formed from a single layer of material. In this embodiment, polishing pad 40 is implemented using a standard commercially available polishing pad such as an IC1000 polishing pad available from Rodel Corp., ranging in thickness from about 32 mils to about 150 mils. Polishing pad 40 is mounted on a subpad 52, which is also formed from a single layer of material. In this embodiment, subpad 52 is implemented with a standard commercially available subpad such as a SubaIV available from Rodel, ranging in thickness from about 30 mils to about 150 mils.

As shown in FIG. 5, grooves 41 are formed in polishing pad 40 without completely penetrating through the polishing pad. Grooves 41 are formed in such a manner so that polishing pad 40 remains relatively rigid or stiff. If grooves 41 completely penetrated polishing pad 40, the WIWNU performance of the CMP operation tends to be detrimentally affected. The depth of grooves 41 is optimized for particular process parameters and slurry, trading between stiffness of the polishing pad and slurry distribution.

Although not part of polishing pad 40, FIG. 5 shows a portion of the polishing table or platen 54 upon which pad assembly 50 is mounted. In this example, table 54 includes a hard urethane pad backer 54A, which is mounted on a steel base 54B. The pad backer 54A can be pressurized by an underlying air bladder (not shown). Pad backer 54A and steel base 54B form part of the table 54, and is considered separate from pad assembly 50.

Figure 6:
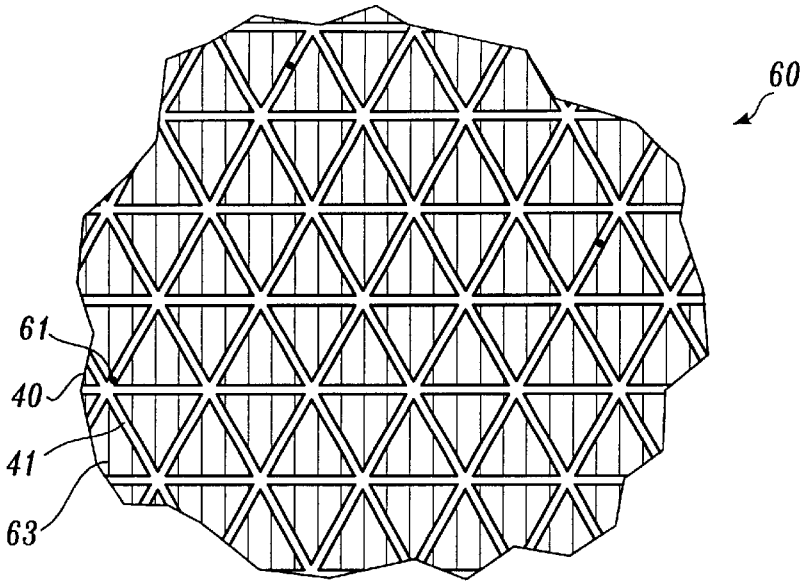
FIGS. 6A–6C are diagrams illustrating portions of a polishing pad, according to different embodiments of the present invention.
Figure 6A:
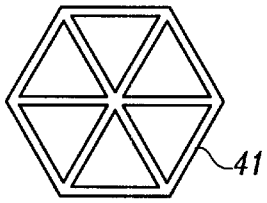

FIG. 6 illustrates in more detail a portion 60 of the surface of polishing pad 40 (FIG. 4). As previously described, a large number of grooves 41 are formed in polishing pad 40. In one embodiment, each groove is about 30 mils wide and about 35 mils deep. The "hexagonal" groove pattern is formed in this embodiment by forming three sets of parallel grooves using a standard grooving tool. For example, a parallel saw grooving tool available from SpeedFam-IPEC can be used. In each set of parallel grooves, the grooves are separated by about 0.25 inches. The separation distance can be different in other embodiments, depending on the desired size of the "hexagons". After the first set of parallel grooves is formed, polishing pad 40 is rotated by about 60° and then the second set of parallel grooves is formed. The third set of parallel grooves is formed after rotating polishing pad 40 by about 60° in the same direction. These three sets of parallel grooves form a pattern of triangles on the surface of polishing pad 40. However, by considering each intersection of grooves 41 as a center point, the six triangles touching the intersection form a hexagon. This pattern is illustrated in FIG. 6A. Considered in this fashion (i.e., each intersection being the center of a hexagon), it is clear that grooves 41 form a pattern of overlapping hexagons. Additionally, a large number of slurry holes 61 are uniformly distributed across polishing pad. In particular, slurry holes 61 are formed to align with slurry distribution holes in table 54 (FIG. 4).

Figure 6B:
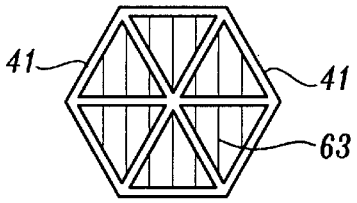
Figure 6C:
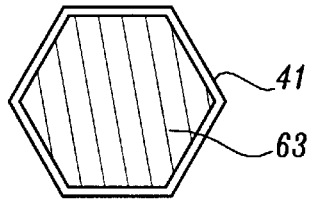

FIG. 6B illustrates a hexagonal portion of polishing pad 40 (FIG. 4) according to another embodiment of the present invention. In particular, the portion shown in FIG. 6B is the same as in FIG. 6A, but with the addition of K-grooves 63. K-grooves 63 are relatively narrow shallow grooves used to improve polishing performance. Another embodiment is illustrated in FIG. 6C. In this embodiment, grooves 41 are formed so as to form hexagons directly, without forming triangles. Such a pattern is more difficult to form using a grooving tool, but can be machined using a CNC machine. It may also be possible to form the pattern using a mold in fabricating the polishing pad. Although hexagonal patterns are shown, other patterns with relatively large angles can be used in other embodiments. For example, a pattern of overlapping circles, octagons, etc. may be used in other embodiments.

Figure 7:
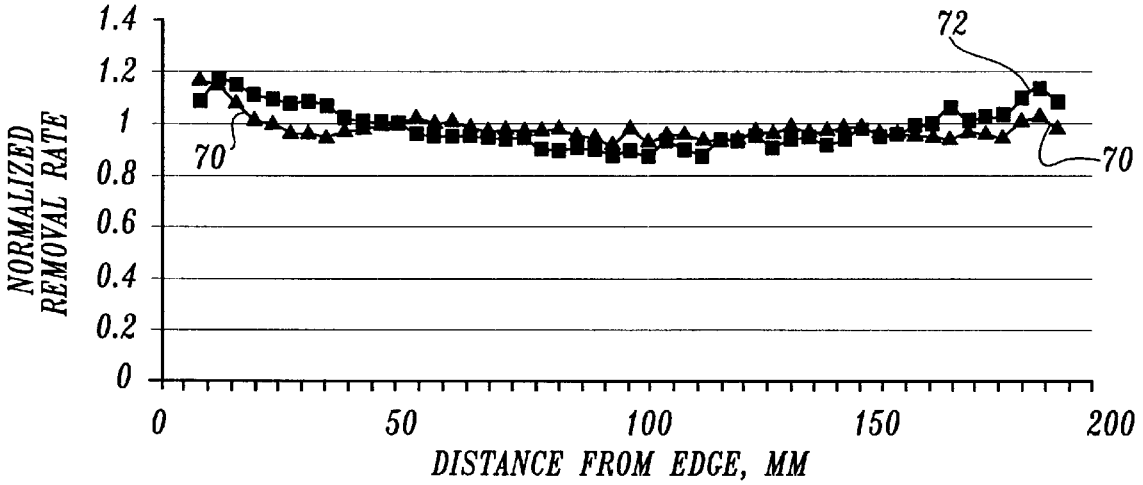
FIG. 7 is a graph illustrating the RR and WIWNU profiles achieved using the polishing pad of FIG. 4 in a Cu CMP application, with reference RR and WIWNU profiles from a conventional rectangular groove pattern polishing pad.
Figure 8:
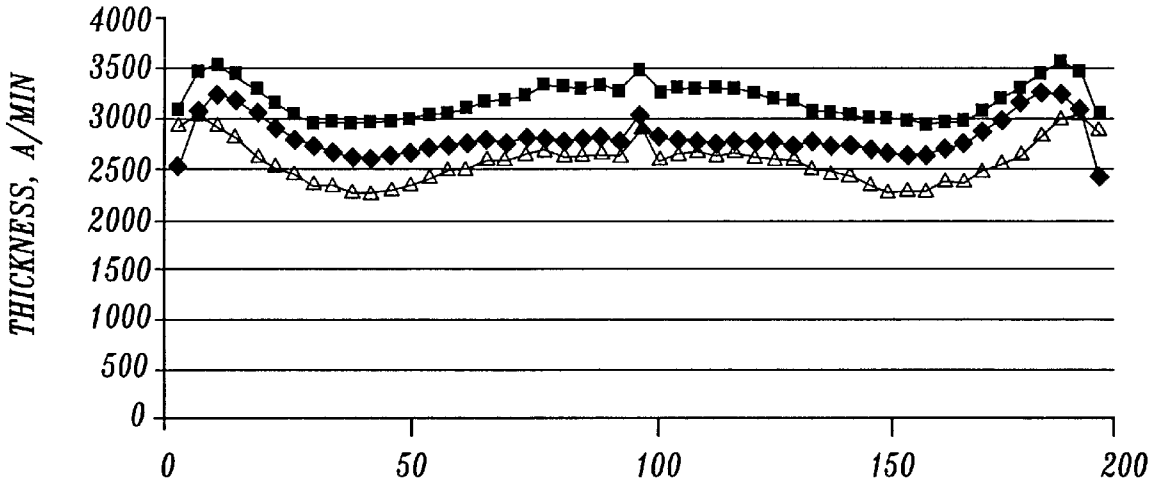
FIG. 8 is a graph illustrating the RR and WIWNU profiles achieved using the polishing pad of FIG. 4 in an oxide CMP application, with reference RR and WIWNU profiles from a conventional rectangular groove pattern polishing pad.

FIG. 7 illustrates the RR and WIWNU profiles across a diameter of a wafer achieved using polishing pad 40 (FIG. 4) in a copper CMP application. The normalized RR rate profile achieved using the pattern of FIG. 6B (i.e., triangles with K-grooves) is represented by a curve 70. For comparison, the normalized RR rate profile achieved using a standard rectangular pattern is represented by curve 72. Due to its relatively high removal rate at the center of the wafer, the hexagonal groove pattern achieves a relatively uniform RR across the diameter of the wafer. In contrast, the conventional rectangular groove pattern has a relatively high RR at the edges of the wafer and a relatively low RR at the center of the wafer. Thus, the rectangular groove pattern has a relatively non-uniform RR across the diameter of the wafer. Accordingly, in this copper CMP application, the hexagonal groove pattern improves RR and WIWNU performance over the conventional rectangular groove pattern. Similar improvements in RR and WIWNU have been observed in silicon oxide CMP applications, as illustrated in FIG. 8. Further, as described below, the hexagonal groove pattern also achieves unexpectedly large improvement in stability (i.e., consistency in RR and WIWNU performance over a large number of wafers).

Figure 9:
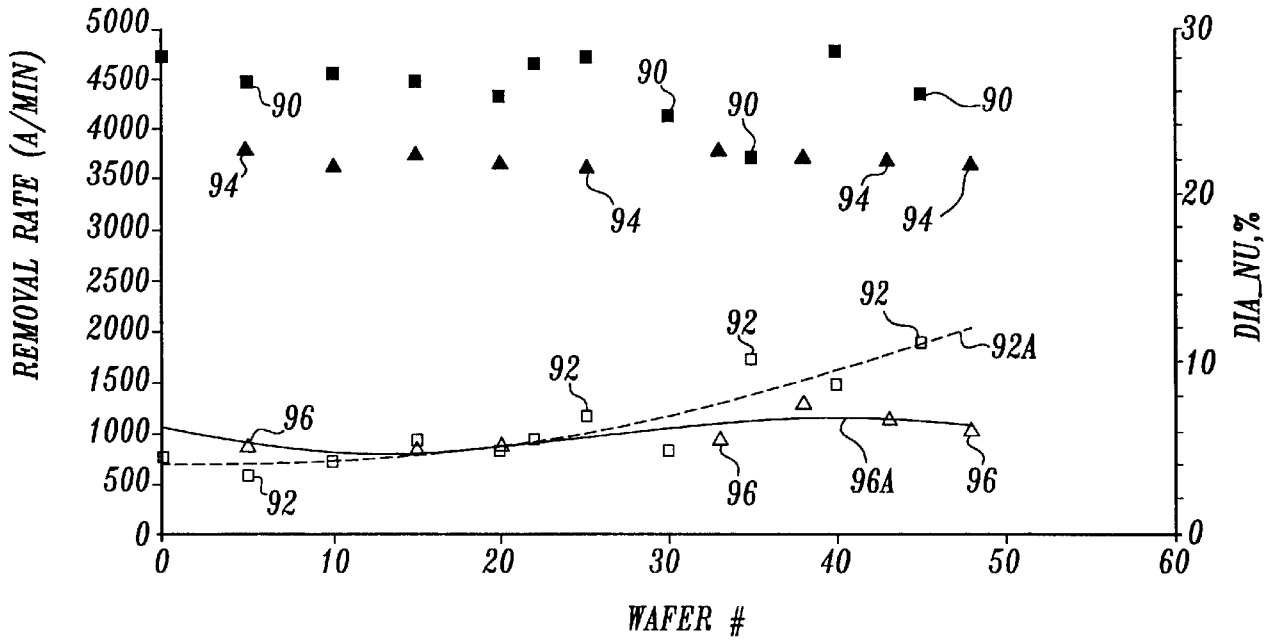
FIG. 9 is a graph illustrating RR and WIWNU measurements over a large number of wafers after CMP using the polishing pad of FIG. 4.

FIG. 9 is a graph illustrating the stability achieved using a polishing pad similar to polishing pad 40 (FIG. 4) in a copper polishing application. For comparison, FIG. 9 also illustrates the stability achieved using a polishing pad with a conventional rectangular groove pattern. In this example, approximately fifty wafers were polished, with the polishing pad being conditioned after each wafer was polished. A standard pad conditioner unit and conditioning recipe was used to condition the polishing pad.

In particular, the RR and WIWNU using a conventional rectangular groove pattern are represented by points 90 and 92, respectively. The RR and WIWNU using a polishing pad like polishing pad 40 (FIG. 4) are represented by points 94 and 96, respectively. Curves 92A and 96A represent polynomial fitting of the points 92 and 96, respectively. The conventional rectangular groove pattern achieved a relatively large average RR; however, as indicated by points 90, the RR varied from about 3800 Å/minute to about 4800 Å/minute over about fifty wafers. Further, large changes in RR began to occur after about twenty to twenty-five wafers. As shown by curve 92A, the WIWNU achieved by the rectangular groove pattern increases with the number of wafers and, further, begins to rise to generally unacceptable levels after about twenty-five wafers. Thus, after about twenty-five wafers are polished, the polishing pad needs to be changed to ensure that the polishing process remains reliable and consistent. In a typical industrial application, it is desirable to reduce the number of times that the polishing pad is replaced (which reduces throughput).

In contrast, the hexagonal groove pattern achieved a RR that varied from about 3600 Å/minute to about 3800 Å/minute over about fifty wafers. The inventors have also achieved similar results for sixty wafers. Thus, the average RR of the hexagonal groove pattern is significantly more reliable and consistent that the conventional rectangular groove pattern over a large number of wafers. Further, as shown by curve 96A, the WIWNU of the hexagonal groove pattern remains fairly constant. In particular, the first wafer in the run had a WIWNU of about 5.30%, while the fiftieth wafer had a WIWNU; of about 5.7% (average over fifty wafers is approximately 5.7%).

Because of the small variation in RR and the low WIWNU using the hexagonal groove pattern (i.e., relatively high stability), the same polishing pad can be used for at least two hundred wafers in this copper polishing application, since the polishing pad will be relatively free of polish residue. This large number of uses helps to reduce CMP costs by reducing the number of polishing pads used to polish a given number of wafers. Further, costs are reduced by decreasing the number of times the CMP process must be stopped in order to replace the polishing pad, thereby increasing throughput.

The embodiments of the polishing pad described above are illustrative of the principles of the present invention and are not intended to limit the invention to the particular embodiments described. For example, in light of the present disclosure, those skilled in the art can devise, without undue experimentation, embodiments using different grooving patterns than those described to achieve a desired turn radius for particular CMP applications. In addition to polishing wafers, other embodiments of the present invention can be adapted for use in polishing any type of workpiece. For example, a workpiece may be a semiconductor wafer, a bare silicon or other semiconductor substrate with or without active devices or circuitry, a partially processed wafer, a silicon on insulator, a hybrid assembly, a flat panel display, a Micro Electromechanical Sensor (MEMS), a wafer, a disk for a hard drive memory, or any other material that would benefit from planarization. Other embodiments of the present invention can be adapted for use in grinding and lapping systems other than the described CMP polishing applications. Accordingly, while the preferred embodiment of the invention has been illustrated and described, it will be appreciated that various changes can be made therein without departing from the spirit and scope of the invention.

We claim:

1. A method of chemical mechanical polishing a surface of a workpiece using a polishing pad, the method comprising:

providing a groove pattern on a surface of the polishing pad, the polishing pad having a single continuous layer, wherein the groove pattern has a plurality of bends with a turn radius greater than ninety degrees and wherein the grooves of the groove pattern do not penetrate completely through the polishing pad;

mounting the polishing pad on a subpad;

causing the surface of the workpiece and the grooved surface of the polishing pad to be in contact;

providing slurry to an interface at which the surface of the workpiece and the polishing pad come into contact, wherein the slurry is provided through holes in the polishing pad and subpad; and imparting a relative motion between the substrate and polishing pad to polish the surface of the workpiece, wherein the slurry is distributed across the interface through the groove pattern.

2. The method of claim 1 further comprising performing a pad conditioning operation after polishing the surface of the workpiece.

3. The method of claim 1 wherein the groove pattern partitions the grooved surface into a plurality of surface portions, each surface portion being coupled to at least one neighboring surface portion through non-grooved portion of the polishing pad so that movement of each surface portion in a direction out of a plane containing the grooved surface is dependent at least in part on movement of a neighboring surface portion.

4. The method of claim 1 wherein groove pattern forms a plurality of hexagons on the grooved surface of the polishing pad.

5. The method of claim 4 wherein the groove pattern forms a plurality of overlapping hexagons on the grooved surface of the polishing pad.

6. The method of claim 5 wherein the groove pattern forms a plurality of triangles on the grooved surface of the polishing pad, and wherein groups of six triangles of the plurality of triangles form a hexagon.

7. The method of claim 6 wherein providing the groove pattern comprises:

forming a first set of parallel grooves on the surface of the polishing pad;

forming a second set of parallel grooves on the surface of the polishing pad, wherein the second set of parallel grooves forms an angle of about 60 or 120 degrees with the first set of parallel grooves; and forming a third set of parallel grooves on the surface of the polishing pad, wherein the third set of parallel grooves forms an angle of about 60 or 120 degrees with both the first and second sets of parallel grooves.

8. A polishing pad for use in a chemical mechanical polishing tool, the polishing pad comprising:

a body of a single continuous layer having a first surface and a second surface;

wherein the first surface has formed thereon a groove pattern with a plurality of bends having a turn radius greater than ninety degrees and the grooves of the groove pattern do not penetrate completely through the body; and wherein the second surface is configured to be attached to a subpad.

9. The polishing pad of claim 8 wherein the groove pattern partitions the first surface into a plurality of surface portions, each surface portion being coupled to at least one neighboring surface portion through the body of the polishing pad so that movement of each surface portion in a direction out of a plane containing the first surface is dependent at least in part on movement of a neighboring surface portion.

10. The polishing pad of claim 8 wherein the groove pattern forms a plurality of hexagons on the first surface of the polishing pad.

11. The polishing pad of claim 10 wherein the groove pattern forms a plurality of overlapping hexagons on the first surface of the polishing pad.

12. The polishing pad of claim 11 wherein the groove pattern forms a plurality of triangles on the first surface of the polishing pad, and wherein groups of six triangles of the plurality of triangles form a hexagon.

13. The polishing pad of claim 12 wherein the groove pattern includes three sets of parallel grooves, each set of parallel grooves forming an angle of 60 to 120 degrees with the other two sets of parallel grooves.

14. A method of improving stability of a copper CMP process, the method comprising:

providing a groove pattern on a first surface of the polishing pad, the polishing pad having a single continuous layer, wherein the groove pattern has a plurality of bends with a turn radius greater than ninety degrees and wherein the grooves of the groove pattern do not penetrate completely through the polishing pad;

mounting the polishing pad on a subpad so that a second surface of the polishing pad contacts the subpad;

after polishing a workpiece, providing conditioning fluid at the first surface polishing pad;

causing a pad conditioner and the first surface to contact; and imparting a relative motion between the pad conditioner and polishing pad to condition the first surface, wherein conditioning fluid is distributed across the first surface through the groove pattern.

15. The method of claim 14 wherein the groove pattern partitions the first surface into a plurality of surface portions, each surface portion being coupled to at least one neighboring surface portion through non-grooved portion of the polishing pad so that movement of each surface portion in a direction out of a plane containing the first surface is dependent at least in part on movement of a neighboring surface portion.

16. The method of claim 14 wherein groove pattern forms a plurality of hexagons on the first surface of the polishing pad.

17. The method of claim 16 wherein groove pattern forms a plurality of overlapping hexagons on the first surface of the polishing pad.

18. The method of claim 16 wherein the groove pattern forms a plurality of triangles on the first surface of the polishing pad, and wherein groups of six triangles of the plurality of triangles form a hexagon.

19. The method of claim 18 wherein providing the groove pattern comprises:

forming a first set of parallel grooves on the first surface of the polishing pad;

forming a second set of parallel grooves on the first surface of the polishing pad, wherein the second set of parallel grooves forms an angle of about 60 to 120 degrees with the first set of parallel grooves; and forming a third set of parallel grooves on the first surface of the polishing pad, wherein the third set of parallel grooves forms an angle of about 60 to 120 degrees with both the first and second sets of parallel grooves.

20. The method of claim 19 wherein the parallel lines of the first set of parallel lines are separated by ⅛ inch to 1 inch.

* * * * *